United States Patent [19]

Landry et al.

[11] 4,245,210

[45] Jan. 13, 1981

[54] THICK FILM RESISTOR ELEMENT AND METHOD OF FABRICATING

[75] Inventors: Norman R. Landry, Willingboro; Samuel L. Williams, Glassboro; Robert L. Schelhorn, Cinnaminson, all of N.J.

[73] Assignee: RCA Corporation, New York, N.Y.

[21] Appl. No.: 21,836

[22] Filed: Mar. 19, 1979

[51] Int. Cl.[3] ..... H01C 1/012

[52] U.S. Cl. ..... 338/314; 29/610 R; 29/613; 338/309; 338/320; 338/260

[58] Field of Search ..... 338/314, 307-309, 338/204, 260, 226, 320; 29/613, 610, 611, 620; 427/102, 103, 123-126

[56] References Cited

U.S. PATENT DOCUMENTS

| | | | |
|---|---|---|---|
| 3,654,580 | 4/1972 | Laisi | 338/3 14 X |
| 3,793,717 | 2/1974 | Degenkolb et al. | 29/610 |
| 4,152,689 | 5/1979 | Thompson | 338/226 X |

OTHER PUBLICATIONS

A. Bross et al., *IBM Technical Disclosure Bulletin*, "Modular Resistor Array", vol. 13, No. 5, Oct. 1970.

*Primary Examiner*—C. L. Albritton

*Attorney, Agent, or Firm*—Samuel Cohen; Robert A. Hays

[57] ABSTRACT

A thick film resistor element capable of dissipating relatively large amounts of microwave energy comprises several distinct layers of resistive material overlying an electrically insulating thermally conducting substrate. The final dimensions of the element can be made comparatively small with respect to a conventional element having comparable dissipation capability. The element has a coating of a crossover dielectric material which provides a moisture barrier between the element and the ambient.

9 Claims, 1 Drawing Figure

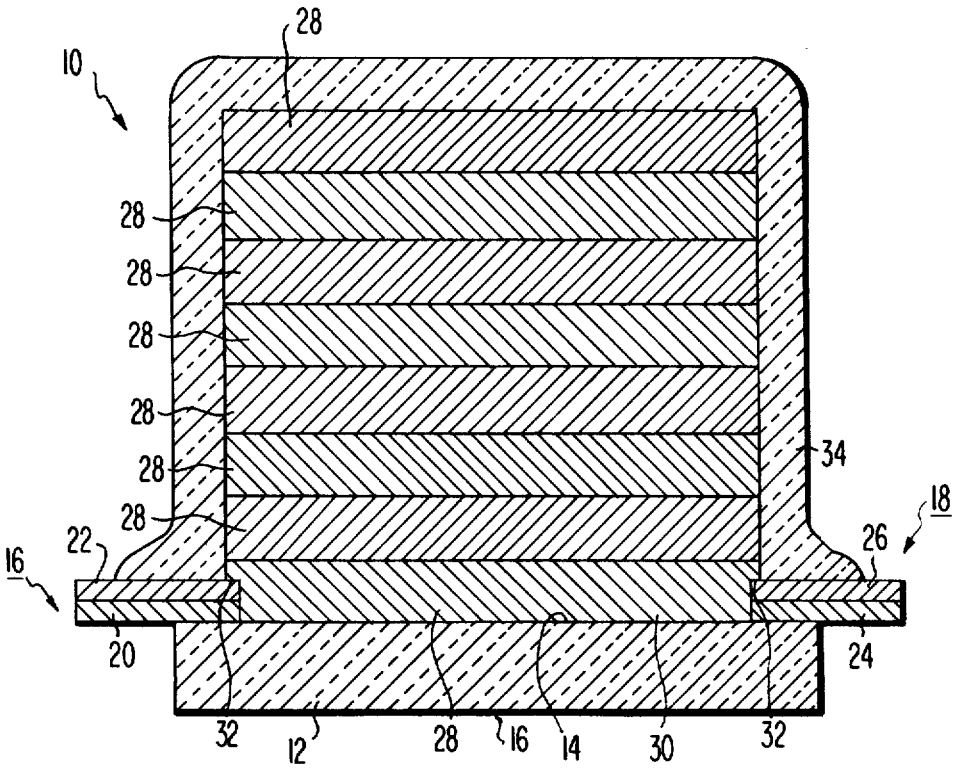
28
10
28
28
28
28
28
28
34
18
22
26
16
20
24
32
12
28
16
14
30
32

THICK FILM RESISTOR ELEMENT AND METHOD OF FABRICATING

The present invention generally relates to thick film elements and, in particular, relates to a thick film resistor element and the method of its manufacture.

Conventional thick film resistors are usually made with one, or at most two, printed thicknesses of resistor material. The resistor material used for conventional resistor elements has a sheet resistivity which provides the desired resistance value when fired to a final thickness. The final ohmic value of conventional thick-film resistors is closely related to the so-called sheet resistivity of the cermet material from which it is made. Since the range of practical aspect ratios, i.e. length/width, is limited for microwave applications, for example, from about ⅓ to about 5/1, the sheet resistivity is ordinarily chosen to correspond rather closely to the desired value of resistance.

Other properties of such resistors, such as temperature coefficient or noise figure, are also dependent on what is usually termed the grain size. The grain size of the unfired cermet paste generally refers to the size of the particles therein. When the cermet is brought to firing temperature the particles of cermet material are sintered into a rigid matrix in the fired cermet paste. The durability and power handling capability of the resulting material is normally considered to be independent of that characteristic. The size and density of the voids within the rigid matrix of the resistor, and the surface roughness thereof, are substantially completely determined by the size of the grains of the unfired cermet paste.

In order to provide a resistor which is capable of handling relatively large amounts of power conventional thick film resistors are usually increased in area, i.e. by being lengthened, widened or both. The increased area of the resistor permits greater power dissipation without increasing the operating temperature to the point where destructive, irreversible changes occur therein. However this approach can lead to excessively large devices when high powered devices are designed for use at microwave frequencies.

Most conventional resistors are made to an initial ohmic value which is somewhat less than the desired value and are then subsequently trimmed. Such trimming may be accomplished, for example, by using known laser burning techniques, to adjust the resistors to their final ohmic value. Conventional trimming techniques usually produce physical discontinuities which can intensify the electric fields and make the resulting resistor less suitable for high voltage, high frequency operation.

It has been discovered that conventional technology for making thick film resistor elements is inappropriate when high powered resistors are to be made for use at microwave frequencies. The application of thick film resistors at microwave frequencies requires the use of resistors having relatively small ohmic values for relatively large power levels with relatively large voltages, currents and electric fields. Indeed it has been observed that microscopic air pockets or similar type voids are present in most conventional resistors and that at high power levels, particularly at microwave frequencies, these voids arc over to create a conductive path through the resistor. This arcing usually results in the catastrophic destruction of the resistor by the resulting high density plasma arc. Most of these voids have been observed within the layer of resistive material or along the interface between the resistive material and the substrate.

It has also been observed that the failure of high-power thick film resistors is associated with the maximum current density at any point. It is known that conduction within sintered cermet resistor materials generally occurs within channels which are substantially aligned with the electric field therein. A resistor having several (three or more) layers has been found to sustain a more uniform current distribution than a resistor comprising only one or two layers.

A novel resistor described in detail hereinafter is capable of operating under relatively large amounts of microwave power without being destroyed. The novel resistor is manufactured by a unique process which enhances its reliability.

The single FIGURE of the drawing is a cross-sectional view of a novel thick film resistor element, not drawn to scale, incorporating the principles of the present invention.

A novel resistor element, indicated generally as 10 in the drawing, embodying the principles of the present invention, comprises an electrically insulating, thermally conducting substrate 12 having surfaces 14 and 16. Preferably the substrate has a length of about 0.6 centimeters and a width of between about 0.30 to about 0.33 centimeters with a thickness of about 0.25 centimeters thick. Although other electrically insulating thermally conducting materials can also be used, beryllium oxide, because of its known properties, is preferred as the material of the substrate 12.

A pair of spaced apart electrodes 16 and 18 overlie and electrically contact surface 14 of substrate 12. Electrodes 16 and 18 are preferably aligned with each other and spaced apart by about 0.37 centimeters. In one embodiment the electrode 16 comprises a first layer 20 of metalization and a second layer 22 of metalization and the electrode 18 comprises a first layer 24 of metalization and a second layer 26 of metalization.

The first layers 20 and 24 of the electrodes 16 and 18 respectively, are adjacent the surface 14 of the substrate 12 and preferably comprise a platinum-gold alloy. One such platinum-gold alloy which can be used for this layer 20 is EMCA 180, manufactured and marketed by Electro Materials Corp. of America of Manaroneck, N.Y. This particular alloy is chosen for its good substrate adhesion property, and is applied in such a fashion that the first layers 20 and 24 are on the order of about 20 micrometers thick. The second layers 22 and 26 which overlie and electrically contact the first layers 20 and 24, respectively, comprise a platinum-gold alloy. Preferably, however, the second layers 22 and 26 are Cermalloy 4121, a platinum-gold alloy manufactured and marketed by Cermalloy Corp. of Conshohocken, Pa. although other alloys may also be used. Cermalloy 4121 is chosen for its adhesion properties, i.e. solderability and resistive ink adhesion quality, related to the incorporation of the completed resistor.

Each of the second layers 22 and 26 preferably has a thickness of about 18 micrometers. Thus the electrodes 16 and 18 have a final fired thickness on the order of about 38 micrometers.

While the above-described electrode structure is satisfactory in the practice of the invention, the preferred embodiment utilizes a single layer of gold for each of the electrodes 16 and 18 instead of the double-layered platinum-gold alloys. One major advantage in using a single layer of gold is that the sheet resistivity thereof is reduced by a factor of about six. Since the same processing techniques, discussed in detail hereinafter, used for the platinum-gold alloys can also be used for the gold; the processing steps associated with the second layers 22 and 26 of the platinum-gold alloy are saved by using the single layer of gold. Preferably, the final thickness of each of the electrodes 16 and 18 is about 20 micrometers when formed of gold, i.e. the layer of gold is about the same thickness as the first layers 20 and 24 described above.

Next, there are several distinct layers 28 of resistive material overlying and electrically contacting the substrate 12. One of the layers 28, designated at 30 in the drawing, of resistive material is contiguous with and electrically contacts portions 32 of electrodes 16 and 18 and thus provides an electrically conductive path therebetween. Each of the layers 28 of resistive material is on the order of about 20 micrometers thick and has a thickness variation tolerance thereacross of ±3.8 micrometers. In addition, each layer 28 should be uniform in thickness with each other layer 28 of resistive material within the same dimensional tolerance. As more full discussed below, each layer 28 is completely formed before a subsequent layer 28 is applied thereon. Preferably the number of layers 28 is between 3 and 10 and the final thickness of the overall resistive material is between from about 60 to about 200 micrometers. As discussed hereinafter, the resistive material is chosen to have a predictable decrease of resistance with repeated firings.

A protective coating 34 overlies and contacts the resistive layers 28 and at least a portion of each of the electrodes 16 and 18. The coating 34 must be relatively high in breakdown voltage, and softening temperature, and must also be impervious to moisture. In the preferred embodiment, the coating 34 is on the order of about 25 micrometers thick and can be composed of known hermetic crystalizable glass crossover dielectric materials which has a firing temperature comparable to that of the resistive material i.e. on the order of about 850° C. and is chemically compatible therewith. Being chemically compatible means that there is no adverse chemical reaction between the material of the coating 34 and anything it contacts. It should be noted that conventional thick film resistors ordinarily are not encapsulated and those that are encapsulated have a relatively low firing temperature coating designed to protect the device from external scratching or damage or chemical attack. One material for use as a suitable overcoat 34 is commonly known as DuPont 9841 a material manufactured and marketed by the DuPont Corporation of Wilmington, Del.

The novel resistor element 10 can be fabricated by utilizing the following steps.

After the substrate 12 is cut and prepared by known techniques the electrodes 16 and 18 are fabricated by utilizing a platinum-gold alloy or preferably just gold with conventional thick film printing techniques. Thereafter, the electrodes 16 and 18 are dried, and fired at a temperature of about 985° C. In the double-layered electrode embodiment, the first layers 20 and 24 of metalization are made from the aforementioned product EMCA 180 manufactured and marketed by Electro Materials Corp. of America of Marnaroneck, N.Y. The second layers 22 and 26 of metalization are also preferably a platinum-gold alloy which is printed directly over the first layers 20 and 24 respectively by conventional techniques. In one embodiment wherein an alloy platinum-gold known as Cermalloy 4121, a product manufactured and marketed by Cermalloy Corporation of Conshohocken, Pa., is used; the second layers 22 and 26 are dried and fired at a temperature of about 850° C. for about eight to ten minutes. It will be understood that in the preferred embodiment wherein a single layer of gold is utilized for the electrodes 16 and 18 only the first layers 20 and 24 are present. The gold layer is formed using the same process described above for the first layers 20 and 24 of platinum-gold alloy.

The layer 30 of resistive material is then printed over the substrate 12 and a portion 32 of the electrodes 16 and 18. In the preferred embodiment, layer 30 of resistive material overlaps each electrode 16 and 18 a minimum of about 0.04 centimeters. The layer 30 resistive material is then fired at a temperature of about 850° C. for about eight to ten minutes. It has been determined that a resistor ink material having a sheet resistivity value of about 1000 ohms per square has a predictable decrease of resistance with repeated firings to yield a resistor having an ohmic value less than about 200 ohms. One such resistive ink is commonly known as DP1431, a product manufactured and marketed by DuPont Inc. of Wilmington, Del. The above resistive ink is desirable because it has a relatively fine grain size, i.e. on the order of about 10 micrometers.

After the layer 30 of resistive ink is dried and fired the next layer 28 of ink is applied directly over the layer 30. This next layer 28 is also dried and fired at a temperature of about 850° C. for about eight to ten minutes. This sequence is carried out the number of times required depending upon the number of layers 28 and the final resistor value desired. For example, to fabricate a 200 ohm resistor it has been determined that five distinct layers 28 of resistive ink, each having a sheet resistivity of about 1,000 ohms per square, is required whereas eight distinct layers of such an ink is required for a 141-ohm resistor. In order to ensure that each layer 28 has the required uniformity, the initial ink is applied in a wet state to a thickness of about 40 micrometers with a uniformity tolerance of about ±8 micrometers.

After the desired number of layers 28 of resistive material are formed the coating 34 of hermetic crossover dielectric is formed over the resistor 10 and is fired at a temperature of about 850° C. for about eight to ten minutes. This results in a final coating 34 having a thickness of about 25 micrometers. Such a coating 34 provides a moisture barrier between the ambient and the resistor material of the element. The exact number of layers 28 of resistive material and the total number of firings is chosen to yield the desired resistor value after overcoating.

The present thick film resistor element 10 is quite useful as a waster load in a microwave power divider. A waster load, as known in the art, is a resistive load at the junction of the output ports of a power divider designed to absorb the out of phase reflection from the output ports. In one such divider the load must be capable of dissipating about 6,000 watts of peak power at a film temperature of about 185° C. and an ambient temperature of about 50° C.

Under laboratory tests, resistor elements 10 such as those described herein and manufactured by the above-described process, did not arc over or burn up and indeed appeared to heal the internal hot spots therein. That is, while it is believed that non-homogenities are initially present in the novel resistor element 10, it appears that when a load is placed on the resistor, the resistive material melts locally around a hot spot and heals it. It has been suggested that the fact that most of the non-homogenities are relatively small and are internal to the element, in addition to the relatively large thickness of the overall element, shunt paths are provided across the non-homogenities which permit the healing to take place. Further, it is felt that the final coating 34 prevents water from forming on the resistor material, or within any microscopic voids, and thereby prevents the void from arcing, such arcing usually being catastrophic to such an element 10. It should be recognized that while this element 10 has been described in terms of a microwave element the structure itself and the method for its manufacture can be utilized for elements to be operated at frequency ranges other than at microwave frequencies.

What is claimed is:

1. A thick film resistor element comprising:

an electrically insulating thermally conducting substrate having a surface;

a pair of spaced apart electrodes attached to said surface;

several distinct layers of resistive material, one of said layers extending between and electrically contacting said electrodes, and the remainder of said layers overlying said one layer, each said remaining layer being adjacent to and in electrical contact with at least one other of said layers, each said layer having a substantially uniform thickness throughout its extent and each of said layers having a substantially uniform thickness with respect to each other; and a layer of hermetic high temperature dielectric material overlying and coating said element.

2. A thick film resistor element as claimed in claim 1 wherein the number of distinct layers is equal to eight (8).

3. A thick film resistor element as claimed in claims 1 or 2 wherein:

each said layer having a thickness of about 20 micrometers and a variation thereacross of less than ±0.8 micrometers.

4. A thick film resistor element as claimed in claim 1 wherein said electrodes comprise:

a single layer of gold.

5. A thick film resistor element as claimed in claim 1 wherein said electrodes comprise:

a first layer of one platinum-gold alloy adjacent said surface; and a second layer of another platinum-gold alloy overlying and electrically contacting said first layer.

6. A thick film resistor element as claimed in claim 1 or 2 wherein said resistive material has a comparatively higher ohms per square value than the final ohmic value of said resistor.

7. A method of fabricating a thick film resistor element comprising the steps of:

forming on a surface of an electrically insulating thermally conductive substrate, a pair of spaced apart electrodes;

forming a layer of resistive material between said electrodes;

repeating said resistive material layer forming step several times in such a fashion that each subsequent layer overlies and electrically contacts its adjacent layer, each layer having a uniform thickness throughout its extent and each said layer having a uniform thickness with respect to each other; and coating said element with a high temperature dielectric material.

8. A method as claimed in claim 7 wherein said resistive material layer forming step comprises:

applying a uniform wet layer of said resistive material over said surface; and firing said layer to a temperature on the order of about 850° C. for a period of about ten minutes.

9. A method as claimed in claims 7 or 8 wherein said resistive material layer forming step is repeated at least seven times.

* * * * *